US007235114B1

(12) United States Patent
Minick et al.

(10) Patent No.: US 7,235,114 B1
(45) Date of Patent: Jun. 26, 2007

(54) FLEXIBLE ABRASIVE ARTICLE

(75) Inventors: Chris A. Minick, Stillwater, MN (US); Ian R. Owen, Baldwin, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/376,899

(22) Filed: Mar. 16, 2006

(51) Int. Cl.
*B24D 3/00* (2006.01)
*B24D 11/00* (2006.01)
*B24D 11/04* (2006.01)

(52) U.S. Cl. ..... 51/295; 51/298; 51/307; 51/308; 51/309; 451/533; 451/536; 451/539

(58) Field of Classification Search ..... 51/307–309, 51/298, 295; 451/533, 536, 539
See application file for complete search history.

(56) References Cited

U.S. PATENT DOCUMENTS

| | | | |
|---|---|---|---|
| 5,219,462 | A | 6/1993 | Bruxvoort et al. |
| 5,707,903 | A | 1/1998 | Schottenfeld |
| 6,419,573 | B1 | 7/2002 | Lise et al. |
| 6,613,113 | B2 | 9/2003 | Minick et al. |
| 6,673,179 | B1 | 1/2004 | Mangum et al. |
| 6,846,232 | B2 | 1/2005 | Braunschweig et al. |
| 6,949,128 | B2 | 9/2005 | Annen |

*Primary Examiner*—Michael Marcheschi
(74) *Attorney, Agent, or Firm*—David B. Patchett

(57) ABSTRACT

A resilient flexible abrasive article includes a continuous backing layer including a support layer coated with foam, the continuous backing layer having opposed major surfaces, at least one of the major surfaces including a three dimensional surface topography including raised and recessed regions, and wherein the raised and recess regions are at least partially coated with abrasive particles, thereby defining an abrasive surface.

19 Claims, 2 Drawing Sheets

FLEXIBLE ABRASIVE ARTICLE

BACKGROUND

The present invention relates generally to abrasive articles and, more particularly, to a flexible resilient abrasive article having an uneven abrasive surface.

Sheet-like abrasives, such as conventional sandpaper, are commonly used in a variety of sanding operations including hand sanding of wooden surfaces. In hand sanding, the user holds the abrasive article directly in his or her hand, or attaches it to a sanding tool, such as a sanding block, and moves the abrasive article across the work surface. Sanding by hand can, of course, be an arduous task. Conventional sandpaper is typically produced by affixing abrasive mineral to a relatively thin, generally non-extensible, non-resilient, non-porous backing (e.g., paper, film etc.).

Resilient sheet-like abrasive articles are also known in the patented prior art. U.S. Pat. No. 6,613,113 (Minick et al.), for example, discloses a flexible abrasive product comprising a flexible sheet-like reinforcing layer comprising a multiplicity of separated resilient bodies connected to each other in a generally planar array in a pattern that provides open spaces between adjacent connected bodies, each body having a first surface and an opposite second surface, and abrasive particles to cause at least the first surface to be an abrasive surface.

It would be desirable to provide a flexible resilient abrasive article that is durable, produces a more uniform scratch pattern, is easy and comfortable to use, has improved cut, and produces finer scratches than a sheet of sandpaper having a comparable grit size.

SUMMARY

The invention overcomes the above-identified limitations in the field by providing a flexible resilient abrasive article that is durable, produces a generally uniform scratch pattern, is easy and comfortable to use, has improved cut, and produces finer scratches than a sheet of sandpaper having a comparable grit size.

The present invention provides a resilient abrasive article comprising a continuous backing layer having opposed first and second major surfaces. The backing layer comprises a support layer coated with a foam layer and at least one of the major surfaces includes a three dimensional surface topography including raised and recessed regions. Abrasive particles are arranged on at least the one surface having a three dimensional surface topography, thereby defining an abrasive surface.

In more specific aspects of the invention, the raised regions comprise peaks and the recessed regions comprise valleys. In one embodiment, the peaks are dome-shaped.

The abrasive particles may be arranged on only the raised regions of the three dimensional surface or on both the raised regions and the recessed regions.

In other aspects of the invention, the raised regions may be provided in a regular repeating pattern, and the valleys may be provided in a rectilinear grid.

In one embodiment, the support layer comprises a scrim. The scrim may be formed of natural fibers, synthetic fibers, or may comprise a nonwoven layer or a woven fabric. In a specific aspect, the scrim contains openings having an area of less than about 10 $mm^2$.

In other aspects, the backing layer generally has a minimum thickness of at least about 2 mm and a maximum thickness of no greater than about 7 mm. In even more specific aspects, the surface having the three dimensional surface topography has an average height differential of from about 0.5 mm to about 2 mm, and average peak to peak distance of from about 3 mm to about 7 mm.

An advantage of certain embodiments of the invention include improved durability, reduced raw material and manufacturing costs, improved scratch pattern, ease of use, more comfortable use, improved cut, and producing finer scratches than a sheet of sandpaper having a comparable grit size.

BRIEF DESCRIPTION OF THE DRAWINGS

The present invention will be further described with reference to the accompanying drawings, in which.

DETAILED DESCRIPTION

Figure 1:
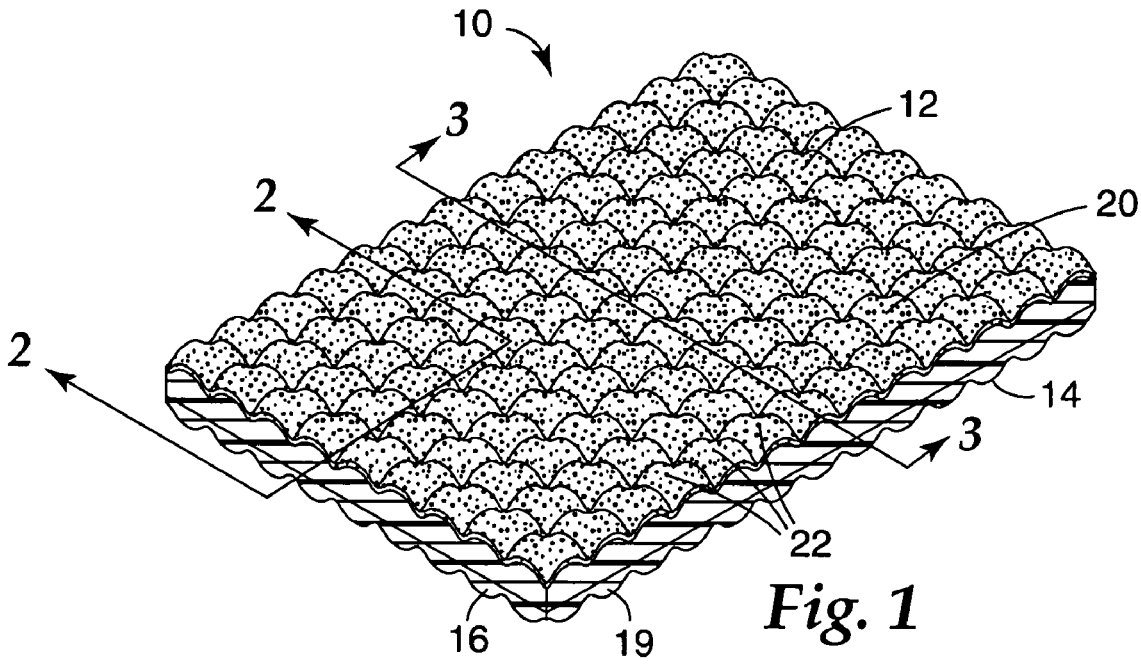
FIG. 1 is a perspective view of a flexible abrasive article according to the invention.
Figure 2:
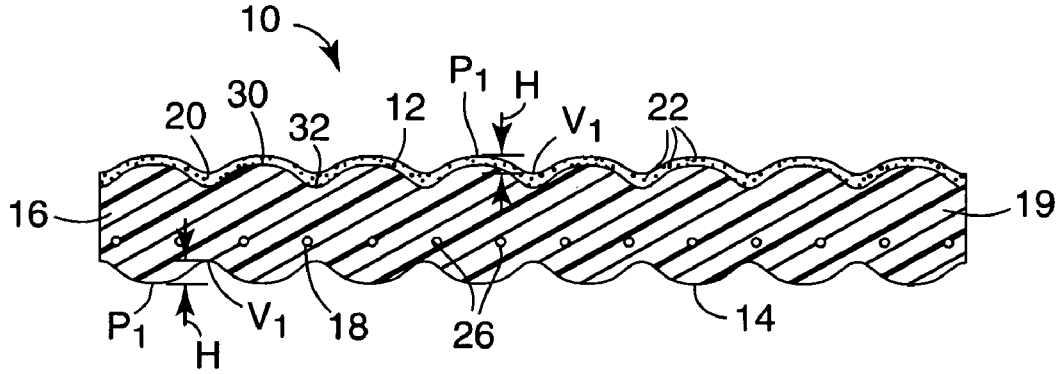
FIG. 2 is an enlarged schematic cross sectional view taken along line 2-2 of FIG. 1.

Referring now to the drawings, wherein like reference numerals refer to like or corresponding parts throughout the several views, FIGS. 1 and 2 show a sheet-like resilient abrasive article 10 having first 12 and second 14 opposed major surfaces. The abrasive article 10 includes a backing layer 16, a support layer 18 arranged within the backing layer 16, a make coat layer 20 arranged on the first major surface 12, and a plurality of abrasive particles 22 at least partially embedded in a make coat 20, thereby defining an abrasive surface. The backing layer 16, support layer 18, make coat layer 20, and abrasive particles 22 are each described in detail below.

Backing layer

The backing layer 16 is formed of a resilient flexible material that provides a comfortable gripping surface for the user, improves the conformability of the abrasive article and, thereby, allows the abrasive article 10 to more effectively sand curved and contoured work surfaces. The backing layer 16 comprises a support layer 18 or scrim coated with foam 19.

Such backing layers 16 may be made according to the method generally described in U.S. Pat. No. 5,707,903 (Schottenfeld), the entire contents of which are hereby incorporated by reference. Such materials may be formed, for example, by dipping the scrim 18 into a liquid composition that is curable to form a polyvinylchloride (PVC) foam.

In accordance with a characterizing aspect of the abrasive article 10, the backing layer 16 is continuous, meaning the backing layer 16 contains no openings, holes, voids, or channels extending therethrough in the Z direction (i.e. the thickness or height dimension of the backing layer) that are larger than the randomly formed spaces in the material itself when the backing layer 16 is made. As explained below, by providing a continuous backing layer, a more durable abrasive article is produced.

Alternatively, the backing layer 16 may be substantially continuous, meaning the backing layer 16 contains either very few or very small openings extending therethrough in the Z direction (i.e. the thickness or height dimension of the backing layer) that are larger than the randomly formed spaces in the material itself when the backing layer is made, which openings do not significantly affect the durability of the backing layer 16. A substantially continuous backing layer, for example, will typically have an open area equal to no greater than about 15% of the total surface area of the backing layer, more typically, no greater than about 10%, and even more typically, no greater than about 5%.

In the illustrated embodiment, the backing layer 16 includes a scrim 18 including parallel threads 24 and cross-parallel threads 26 arranged in a grid-like pattern, thereby defining a plurality of openings 28. Typically, the openings 28 are small enough so that during the coating and curing process used to form the backing layer 16, all of the openings 28 in the scrim 18 are completely coated or filled so there are few, if any, holes in the coated product or, alternatively, so that the holes are very small. If openings are present in the coated backing layer 14, the number and size of the openings is such that they do not have a deleterious affect on the durability of the backing layer 12.

The scrim 18 may be made of natural or synthetic threads that may be either knitted or woven in a network having intermittent openings spaced along the length of the scrim 18. The scrim 18 need not be woven in a uniform pattern, but may also include a random pattern. Thus, the openings 28 may either be in a pattern or randomly spaced. The openings 28 in the scrim 18 may be rectangular or they may have other shapes such as, for example, diamond shaped, triangular, an octagonal shape or a combination of these shapes.

The scrim 18 is embedded within the backing layer 16 (i.e. it is completely surrounded by foam 19). The support layer 18 serves to improve the durability of the abrasive article 10. That is, the support layer 18 serves to enhance the strength of the continuous backing layer 16.

In the illustrated embodiment, the scrim 18 comprises a first set of rows of separated threads 24 deployed in a first direction and a second set of threads 26 deployed in a second direction to provide a grid defining multiple adjacent openings 28. The scrim 18 may also comprise an open mesh selected from the group consisting of woven or knitted fiber mesh, synthetic fiber mesh, natural fiber mesh, metal fiber mesh, molded thermoplastic polymer mesh, molded thermoset polymer mesh, perforated sheet materials, slit and stretched sheet materials and combinations thereof.

The support layer 18 may be formed from a variety of materials. Suitable materials include, for example, knitted or woven fabric materials or cloth, or films such as a thermoplastic film. The particular support layer 18 material will have sufficient strength for handling during processing and sufficient strength to be used for the intended end use application.

The material 19 surrounding the scrim 18 may either be foamed or non-foamed, and may comprise any of a variety of elastomeric materials including, but not limited to, polyurethane resins, polyvinyl chloride resins, ethylene vinyl acetate resins, synthetic or natural rubber compositions, acrylate resins and other suitable elastomeric resin compositions.

In accordance with another characterizing feature of the abrasive article 10, the abrasive first major surface 12 of the abrasive article 10 includes a macroscopically three-dimensional surface topography comprising raised regions 30 and recessed regions 32. The term "macroscopically three-dimensional" means the three-dimensional surface topography of the abrasive article 10 is readily visible to the naked eye when the perpendicular distance between the viewer's eye and the plane of the sheet is about 12 inches. In other words, the three-dimensional structure of the abrasive article is such that one or both opposed major surfaces of abrasive article exist in multiple planes, where the distance between those planes is observable to the naked eye when the structure is observed from about 12 inches. In contrast, an abrasive article having a planar surface would have fine-scale surface aberrations on one or both sides, the surface aberrations not being readily visible to the naked eye when the perpendicular distance between the viewer's eye and the plane of the web is about 12 inches or greater. In other words, on a macro scale, the observer would not observe that one or both surfaces of the sheet exist in multiple planes so as to be three-dimensional.

In the illustrated embodiment, both the first and second major surfaces 12, 14 of the abrasive article 10 include a three-dimensional surface topography. The first major surface 12 is coated with abrasive particles 22 to define an abrasive surface, and the opposed second major surface 14 is uncoated. The uncoated second major surface 14 provides an easily handleable backside of the abrasive article 10 that easily conforms to the hand of a user to provide a convenient deformable product that is easily utilized to abrade surfaces having a complex shape. Optionally, the second major surface 14 may also be an abrasive surface, thereby forming a double sided abrasive article. In the illustrated embodiment, each raised region 30 on the abrasive first major surface 12 has a generally convex or domed shape. The raised regions 30 may be provided with other shapes.

The macroscopic three dimensional surface topography of the abrasive article can be characterized in terms of "average height differential" and "average peak to peak distance." The height differential is the distance between the highest point of a raised region (or the center point of a raised region if there is no discernable high point) and the nearest adjacent recessed region of a given surface. The peak-to-peak is the distance between the highest point of a raised region (or the center point of a raised region if there is no discernable high point) and the highest point (or the center point of a raised region if there is no discernable high point) of the nearest adjacent peak of a given surface. The average is determined by measuring the height differential and peak-to-peak distance at ten random locations on the surface of the abrasive article. These measurements can be made, for example, using a video microscope or light microscope equipped with a Z-direction measuring device. The abrasive first major surface 12 of the abrasive article of the present invention typically has an average height differential of less than about 3 mm and more typically less than about 2 mm. The abrasive first major surface 12 of the abrasive article of the present invention typically has a minimum average peak-to-peak distance of at least about 3 mm, more typically, at least about 4 mm, and even more typically at least about 5 mm, and has a maximum average peak-to-peak distance of no greater than about 20 mm, more typically, no greater than about 15 mm, and even more typically, no greater than about 10 mm.

The backing layer 16 has a sufficient thickness to make it convenient for being hand-held and to provide a comfortable grip, and/or to allow it to be installed on a sanding tool. The thickness of the abrasive article 10 is defined as the distance between an imaginary plane connecting the high points of the first major surface 12 and an imaginary plane connecting the high points of the second major surface 14. The minimum thickness of the abrasive article 10 is typically at least about 2 mm, more typically at least about 3 mm, and even more typically at least about 4 mm, and the maximum thickness of the abrasive article 10 is typically no greater than about 8 mm, more typically no greater than about 7 mm, and even more typically, no greater than about 6 mm.

While the raised regions 30 may have a square or rectangular shape, they may be any convenient geometric shape including, but not limited to, square, rectangular, triangular, circular, oval, and in the shape of a polygon. The raised regions 30 are typically uniform in shape, but they need not be. The raised regions 30 may be aligned in rows longitudinally and/or in a transverse direction. The raised regions 30 may be discrete regions or peaks, or they may comprise elongated ridges that extend the entire length and/or width of the abrasive article 10. The recessed regions 32 may comprise discrete regions or they may comprise elongated valleys. In the illustrated embodiment, the recessed regions 32 comprise a rectilinear array of valleys forming an x-y grid in which the valleys extend across the entire length and width of the abrasive article 10.

For discrete raised regions 30, the dimensions of the raised regions 30 may vary from about 2 to about 25 mm, preferably from 5 to 10 mm. Each "dimension" refers to the dimension of a side if rectangular, the diameter if circular, or the maximum dimension if of an irregular shape. The shapes of the raised regions 30 need not be a defined shape but could be randomly shaped. When referring to the dimensions of the raised regions 30, the dimensions are intended to include the widths in the longitudinal or transverse direction or the maximum dimension of the body when measured from one side to the other, notwithstanding any direction. Alternatively, each raised region 30 may have an area (defined as the area bounded by one or more recessed regions and/or the ends of the abrasive article 10) of no greater than about 25 $mm^2$, more typically no greater than about 20 $mm^2$, and even more typically, no greater than about 15 $mm^2$.

In a preferred embodiment, the backing layer 16 is of the type formed from a scrim 18 coated with a polyvinyl chloride (PVC) foam 19. The scrim 18 may be made of natural or synthetic fibers which are either knitted or woven into a network having intermittent openings 28 spaced along the surface of the scrim 18. The openings 28 are generally uniformly spaced along the scrim 18 in a repeating pattern. The openings 28 may also be randomly spaced. Further, the openings 28 may be rectangular as shown or they may be other shapes, including diamonds, triangles, octagons or combinations of the these shapes.

A suitable backing layer 16 is formed by dipping the scrim 18 in liquid PVC and curing the dipped scrim in an oven. While being cured, a chemical reaction causes gas to be entrained in the PVC as it solidifies, thereby causing voids in the PVC. When the PVC solidifies entirely, the voids remain in the PVC to produce a soft, resilient, elastomeric, foam material. Materials suitable for the backing layer 16 are available from Bayeux Cortina Fabrics, Inc., Swepsonville, N.C. Materials of this type are generally known in the art and will not be described in further detail.

Figure 3:
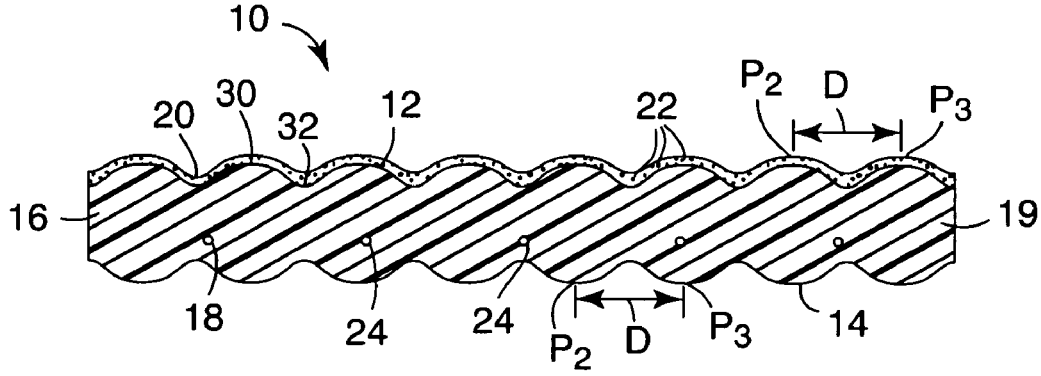
FIG. 3 is an enlarged schematic cross sectional view taken along line 3-3 of FIG. 1.
Figure 4:
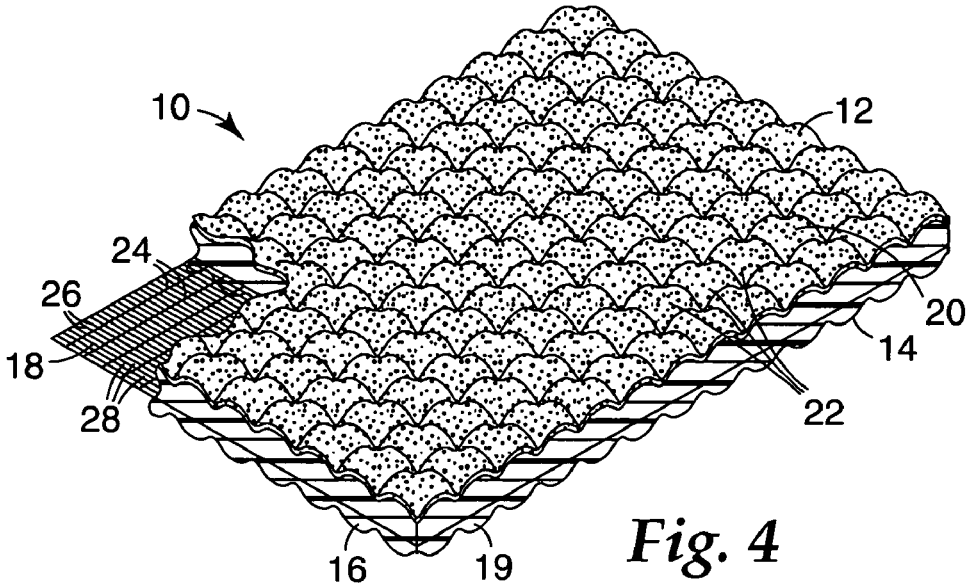
FIG. 4 is a perspective view of the abrasive article of FIG. 1 partially cut-away to show the support layer.
Figure 5:
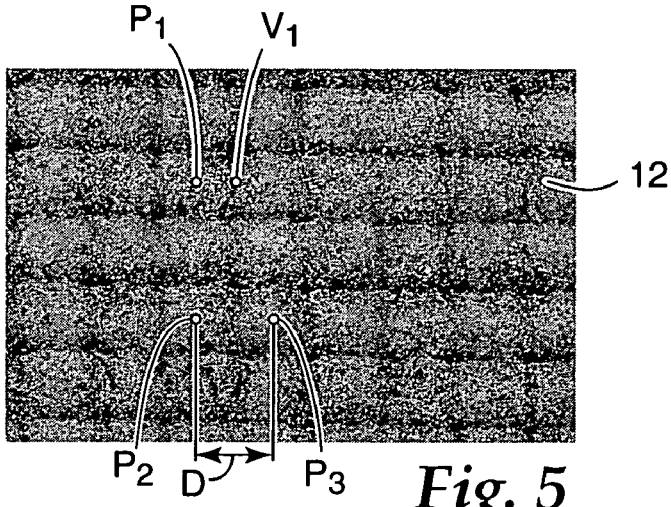
FIG. 5 is an enlarged top view photograph (approximately 5× magnification) of the abrasive surface of a flexible abrasive article according to one embodiment of the invention.

FIG. 5 is an enlarged photograph showing the abrasive top surface 12 of a flexible abrasive article according to one embodiment of the invention. The backing layer 16 is of the type formed from a scrim coated with a PVC foam. The upper surface 12 shown in FIG. 5 was then coated with a make coat adhesive and abrasive particles were then deposited on the make coat to form the abrasive surface. The abrasive top surface 12 has a three-dimensional surface topography including discrete raised regions separated by a grid of recessed valleys. The raised regions have a generally square base having an area ranging from about 20 $mm^2$ to about 30 $mm^2$, and a generally dome-shaped upper region. As depicted in FIGS. 2, 3 and 5, the abrasive surface 12 has a height differential H—measured as the elevational distance (i.e. the Z-direction distance) between point $P_1$ and point $V_1$—of about 1.5 mm, and a peak-to-peak distance D measured between peak $P_2$ and peak $P_3$ of about 4.5 mm. The backing layer 16 had a thickness T of about 5 mm.

Figure 6:
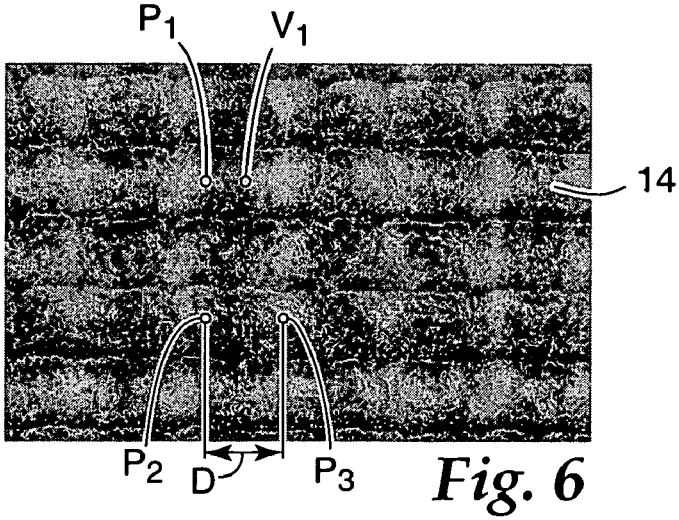
FIG. 6 is an enlarged bottom view photograph (approximately 5× magnification of the non-abrasive surface of a flexible abrasive article according to one embodiment of the invention.

FIG. 6 is an enlarged photograph showing the bottom uncoated surface 14 of a flexible abrasive article. The bottom surface 14 has a three-dimensional surface topography including discrete raised regions separated by a grid of recessed valleys. The raised regions have a generally square base having an area ranging from about 20 $mm^2$ to about 30 $mm^2$, and a generally dome-shaped upper region. As depicted in FIGS. 2, 3 and 6, the bottom surface 14 has a height differential H—measured as the elevational distance (i.e. the Z-direction distance) between point $P_1$ and point $V_1$—of about 1.5 mm, and a peak-to-peak distance D measured between peak $P_2$ and peak $P_3$ of about 4.5 mm.

Make Coat

In general, any make coat 20 may be used to adhere the abrasive particles 22 to the backing layer 16. A preferred make coat is a phenolic resin. The make coat 20 may be coated onto the backing layer 16 by any conventional technique, such as knife coating, spray coating, roll coating, rotogravure coating, curtain coating, and the like. The abrasive article 10 may also include an optional size coat over the abrasive particles 22.

Abrasive Particles

In general, any abrasive particles may be used with this invention. Suitable abrasive particles include fused aluminum oxide, heat treated aluminum oxide, alumina-based ceramics, silicon carbide, zirconia, alumina-zirconia, garnet, diamond, ceria, cubic boron nitride, ground glass, quartz, titanium diboride, sol gel abrasives and combinations thereof. The abrasive particles can be either shaped (e.g., rod, triangle, or pyramid) or unshaped (i.e., irregular). The term "abrasive particle" encompasses abrasive grains, agglomerates, or multi-grain abrasive granules. The abrasive particles can be deposited onto the make coat by any conventional technique such as electrostatic coating or drop coating.

The abrasive article 10 of the present invention may be provided with abrasive particles 22 of any size. However, because the benefit of providing the abrasive article 10 with a continuous backing later 16 is particularly apparent when the abrasive article 10 includes coarse grade abrasive particles—that is, because coarse grade abrasive particles are more likely to cause damage to the backing layer 16 if the backing layer 16 is not continuous or substantially continuous—in accordance with a specific aspect of the invention, the abrasive particles 22 are typically coarse grade abrasive particles having a grit size of about 20 to about 100, and more typically from about 30 to about 90, and even more typically, from about 40 to about 80.

Additives

The make coat or the size coat or both can contain optional additives, such as fillers, fibers, lubricants, grinding aids, wetting agents, thickening agents, anti-loading agents, surfactants, pigments, dyes, coupling agents, photoinitiators, plasticizers, suspending agents, antistatic agents, and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. The amounts of these materials are selected to provide the properties desired, as known to those skilled in the art.

Persons of ordinary skill in the art may appreciate that various changes and modifications may be made to the invention described above without deviating from the inventive concept. Thus, the scope of the present invention should not be limited to the structures described in this application, but only by the structures described by the language of the claims and the equivalents of those structures.

What is claimed is:

1. A resilient abrasive article, comprising:

(a) a continuous backing layer having opposed first and second major surfaces, the backing layer comprising a support layer coated with a foam layer, wherein at least one of the major surfaces includes a three dimensional surface topography including raised and recessed regions; and (b) abrasive particles arranged on the at least one surface having a three dimensional surface topography, thereby defining an abrasive surface.

2. An abrasive article as defined in claim 1, wherein the raised regions comprise peaks.

3. An abrasive article as defined in claim 1, wherein the recessed regions comprise valleys.

4. An abrasive article as defined in claim 2, wherein the peaks are dome-shaped.

5. An abrasive article as defined in claim 1, wherein the abrasive particles are arranged on both the raised regions and the recessed regions.

6. An abrasive article as defined in claim 1, wherein the raised regions are provided in a regular repeating pattern.

7. An abrasive article as defined in claim 1, wherein the recessed regions are provided in a rectilinear grid.

8. An abrasive article as defined in claim 1, wherein the support layer comprises a scrim.

9. An abrasive article as defined in claim 8, wherein the scrim is formed of natural fibers.

10. An abrasive article as defined in claim 8, wherein the scrim is formed of synthetic fibers.

11. An abrasive article as defined in claim 8, wherein the scrim comprises a nonwoven layer.

12. An abrasive article as defined in claim 8, wherein the scrim comprises a woven fabric.

13. An abrasive article as defined in claim 8, wherein the scrim contains openings having an area of less than about 10 $mm^2$.

14. An abrasive article as defined in claim 1, wherein the backing layer has a minimum thickness of at least about 2 mm and a maximum thickness of no greater than about 6 mm.

15. An abrasive article as defined in claim 1, wherein the surface having the three dimensional surface topography has an average height differential of at least about 0.5 mm.

16. An abrasive article as defined in claim 1, wherein the surface having the three dimensional surface topography has an average peak to peak distance of at least about 3 mm.

17. An abrasive article as defined in claim 1, wherein the backing layer exhibits an open area equal to no greater than about 15% of a total surface area of the backing layer.

18. An abrasive article as defined in claim 1, wherein the backing layer exhibits a cumulative openness as compared to a total area of the backing layer of no greater than about 15%.

19. An abrasive article as defined in claim 1, wherein the abrasive surface is continuous across the recessed regions.

* * * * *